US009635922B2

(12) United States Patent
Logsdon

(10) Patent No.: US 9,635,922 B2
(45) Date of Patent: May 2, 2017

(54) HUMIDIFICATION ASSEMBLY

(71) Applicant: Darren Logsdon, Austin, TX (US)

(72) Inventor: Darren Logsdon, Austin, TX (US)

( * ) Notice: Subject to any disclaimer, the term of this patent is extended or adjusted under 35 U.S.C. 154(b) by 204 days.

(21) Appl. No.: 14/574,624

(22) Filed: Dec. 18, 2014

(65) Prior Publication Data

US 2016/0177499 A1 Jun. 23, 2016

(51) Int. Cl.

| | |
|---|---|
| ***A45D 20/12*** | (2006.01) |
| *F24F 6/00* | (2006.01) |
| *A45D 20/10* | (2006.01) |
| *A45D 20/42* | (2006.01) |
| *A45D 19/16* | (2006.01) |
| *B01F 5/04* | (2006.01) |
| *B01F 15/02* | (2006.01) |

(52) U.S. Cl.

CPC ..... *A45D 20/12* (2013.01); *A45D 20/122* (2013.01); *A45D 19/16* (2013.01); *A45D 20/10* (2013.01); *A45D 20/42* (2013.01); *A45D 2200/202* (2013.01); *B01F 5/0413* (2013.01); *B01F 15/026* (2013.01); *B01F 15/0261* (2013.01); *B01F 2005/0435* (2013.01); *F24F 6/00* (2013.01)

(58) Field of Classification Search

CPC ..... A45D 20/12; A45D 20/10; A45D 19/16; A45D 20/122; A45D 20/124; A45D 2020/126; A45D 2020/128; A45D 2200/202; A45D 20/42; B01F 2005/0435; B01F 5/0413; B01F 15/026; B01F 15/0261; B01F 15/801; F24F 6/00

See application file for complete search history.

(56) References Cited

U.S. PATENT DOCUMENTS

| | | | | |
|---|---|---|---|---|
| 2,982,030 A * | 5/1961 | Zemour | A45D 20/22 34/100 |
| 3,814,898 A | 6/1974 | Levine | |
| 3,943,329 A * | 3/1976 | Hlavac | A45D 20/122 219/486 |
| 3,947,659 A * | 3/1976 | Ono | A45D 20/00 34/91 |

(Continued)

FOREIGN PATENT DOCUMENTS

| | | |
|---|---|---|
| CN | 202222657 U * | 5/2012 |
| CN | 204015449 U * | 12/2014 |

(Continued)

*Primary Examiner* — Amber R Orlando
*Assistant Examiner* — Stephen Hobson

(57) ABSTRACT

A humidification assembly includes a housing that has a first end, a second end and a peripheral wall extending therebetween. The first end and the second end are open. The housing is substantially hollow. The peripheral wall is curvilinear such that the housing has a cylindrical shape. The first end may insertably receive a hair dryer. A gasket is coupled to an inside surface of the peripheral wall. The gasket may frictionally engage the hair dryer air outlet to retain the housing on the hair dryer. A reservoir is provided to contain a fluid. The peripheral wall has a fill aperture extending into the reservoir. The fill aperture directs the fluid into the reservoir. A closure removably closes the fill aperture. A valve is movably coupled between the housing and the venturi. The valve selectively releases the fluid into the venturi to humidify the air urged by the hair dryer.

8 Claims, 6 Drawing Sheets

(56) References Cited

U.S. PATENT DOCUMENTS 4,038,759 A * 8/1977 Dyer ..... A45D 20/18 34/99
4,114,022 A * 9/1978 Braulke, III ..... A45D 20/08 132/212
4,605,019 A * 8/1986 Reynolds ..... A45D 20/12 132/272
4,991,561 A * 2/1991 Gerassimov ..... F02B 43/00 123/527
5,241,974 A * 9/1993 Tsai ..... A45D 20/12 132/272
5,467,540 A * 11/1995 Bastien ..... A45D 20/122 34/283
5,572,800 A * 11/1996 West ..... A61L 9/03 34/390
5,649,370 A * 7/1997 Russo ..... A45D 20/12 34/97
5,761,824 A * 6/1998 Moon ..... A45D 20/12 34/97
5,765,292 A * 6/1998 Chan ..... A45D 20/122 132/212
5,805,406 A * 9/1998 Mailand ..... A45D 20/12 361/212
6,557,266 B2 * 5/2003 Griffin ..... F26B 21/06 34/168
6,601,813 B1 * 8/2003 Kager ..... A45D 20/12 248/288.31
8,240,317 B2 * 8/2012 Aguti ..... A45D 20/12 132/271
D676,600 S 2/2013 Thrasher, Jr.
9,237,789 B2 * 1/2016 Prehodka ..... A45D 20/12
2005/0284495 A1 * 12/2005 Yasuda ..... A45D 20/10 132/272
2006/0064892 A1 * 3/2006 Matsui ..... A45D 19/16 34/96
2006/0153002 A1 * 7/2006 Ryan ..... B01F 5/0413 366/162.4
2006/0248744 A1 * 11/2006 Langley ..... A45D 20/12 34/97
2007/0051008 A1 * 3/2007 Donovan ..... A45D 20/122 34/96
2007/0144549 A1 * 6/2007 Enriquez ..... A45D 24/28 132/116
2008/0235980 A1 * 10/2008 Chasen ..... A45D 20/12 34/91
2009/0078800 A1 * 3/2009 Nakasone ..... A45D 20/12 239/690
2009/0083986 A1 * 4/2009 Langley ..... A45D 20/12 34/98
2010/0301031 A1 * 12/2010 Chu ..... H05B 3/141 219/209
2014/0060565 A1 * 3/2014 Saito ..... A45D 20/12 132/200
2015/0007900 A1 * 1/2015 Li ..... B01F 5/0428 137/892
2015/0093099 A1 * 4/2015 Shelton ..... A45D 20/12 392/380

FOREIGN PATENT DOCUMENTS

DE 102010026513 A1 * 1/2012 ..... B01F 3/0451
WO WO9404116 3/1994

* cited by examiner

HUMIDIFICATION ASSEMBLY

BACKGROUND OF THE DISCLOSURE

Field of the Disclosure

The disclosure relates to humidification devices and more particularly pertains to a new humidification device for equipping a hair dryer to remove wrinkles from a fabric.

SUMMARY OF THE DISCLOSURE

An embodiment of the disclosure meets the needs presented above by generally comprising a housing that has a first end, a second end and a peripheral wall extending therebetween. The first end and the second end are open. The housing is substantially hollow. The peripheral wall is curvilinear such that the housing has a cylindrical shape. The first end may insertably receive a hair dryer air outlet. A gasket is coupled to an inside surface of the peripheral wall. The gasket is coextensive with the first end. The gasket may frictionally engage the hair dryer air outlet to retain the housing on the hair dryer. A reservoir is provided to contain a fluid. The peripheral wall has a fill aperture extending into the reservoir. The fill aperture directs the fluid into the reservoir. A closure removably closes the fill aperture. A valve is movably coupled between the housing and the venturi. The valve selectively releases the fluid into the venturi to humidify the air urged by the hair dryer.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
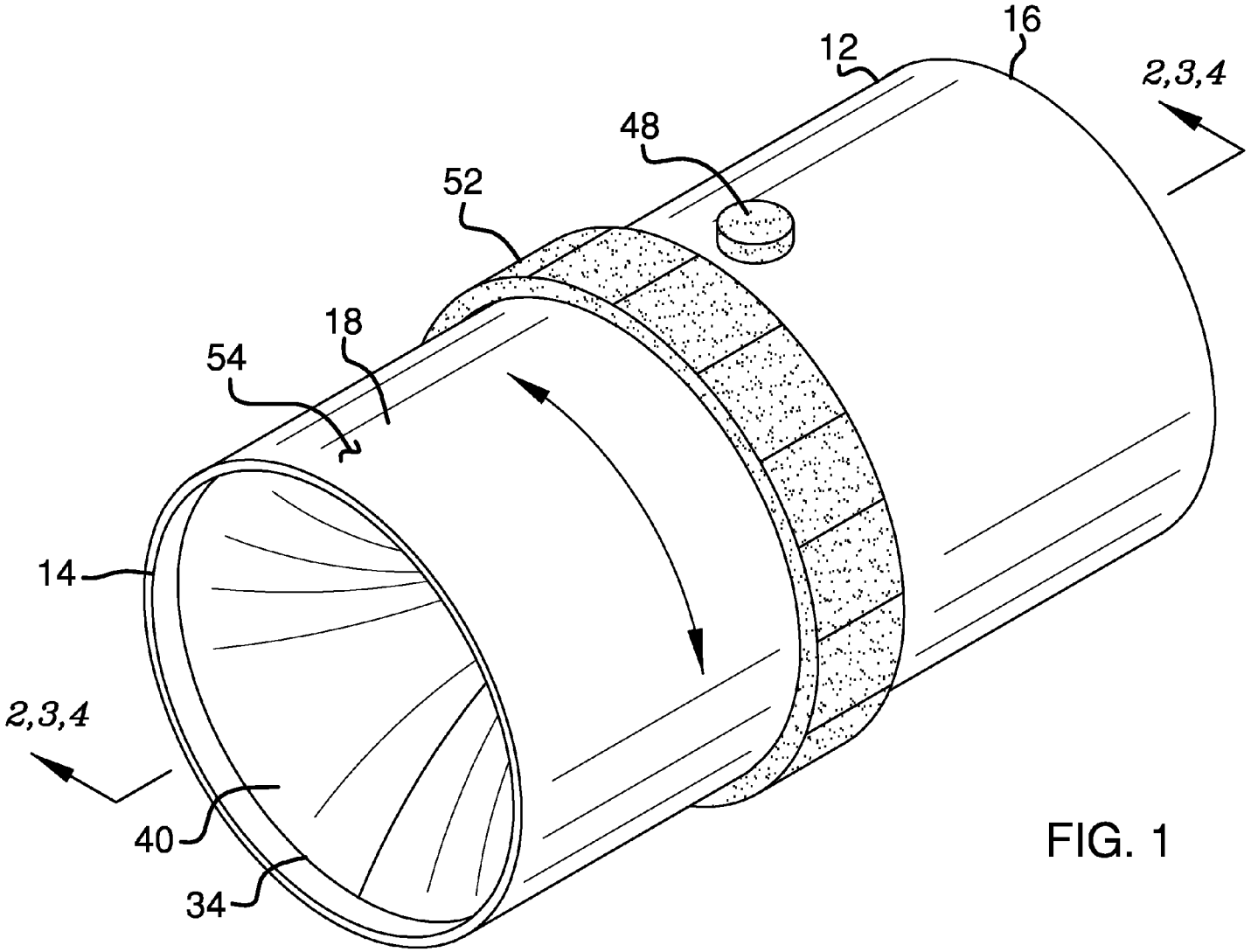
FIG. 1 is a perspective view of a humidification assembly according to an embodiment of the disclosure.
Figure 2:
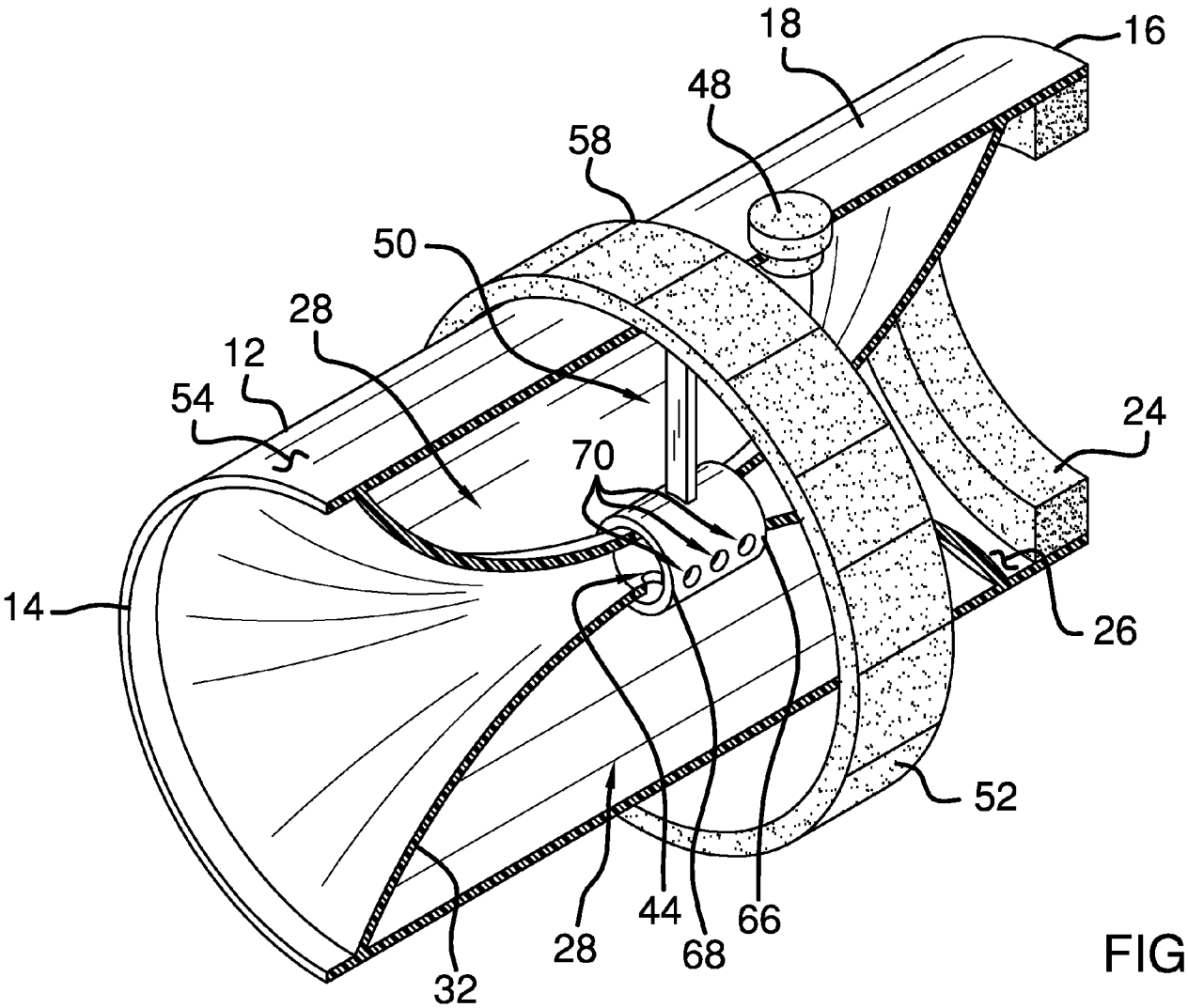
FIG. 2 is a cross sectional view taken along line 2-2 of FIG. 1 of an embodiment of the disclosure.
Figure 3:
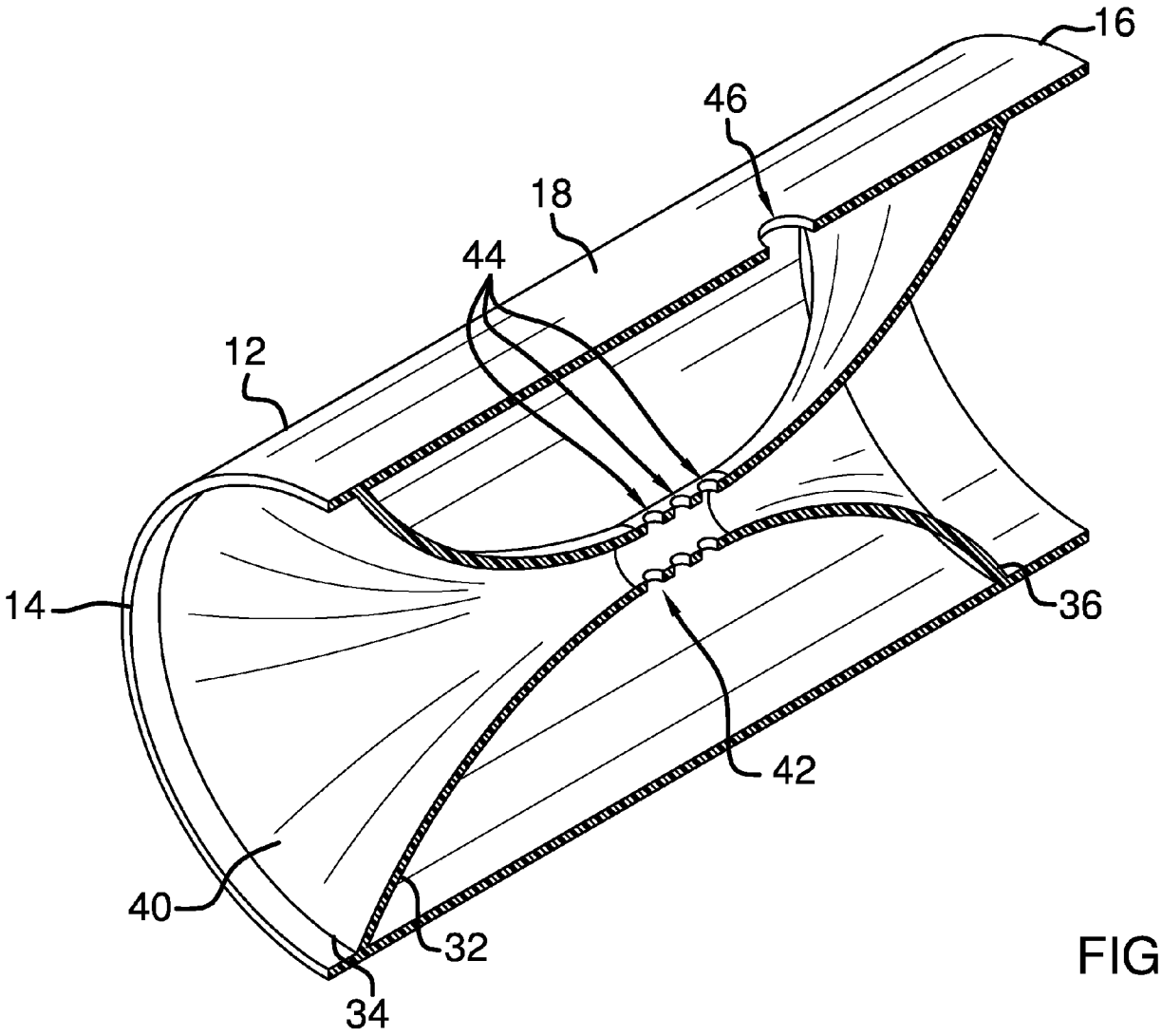
FIG. 3 is a cross sectional view taken along line 3-3 of FIG. 1 of an embodiment of the disclosure.
Figure 4:
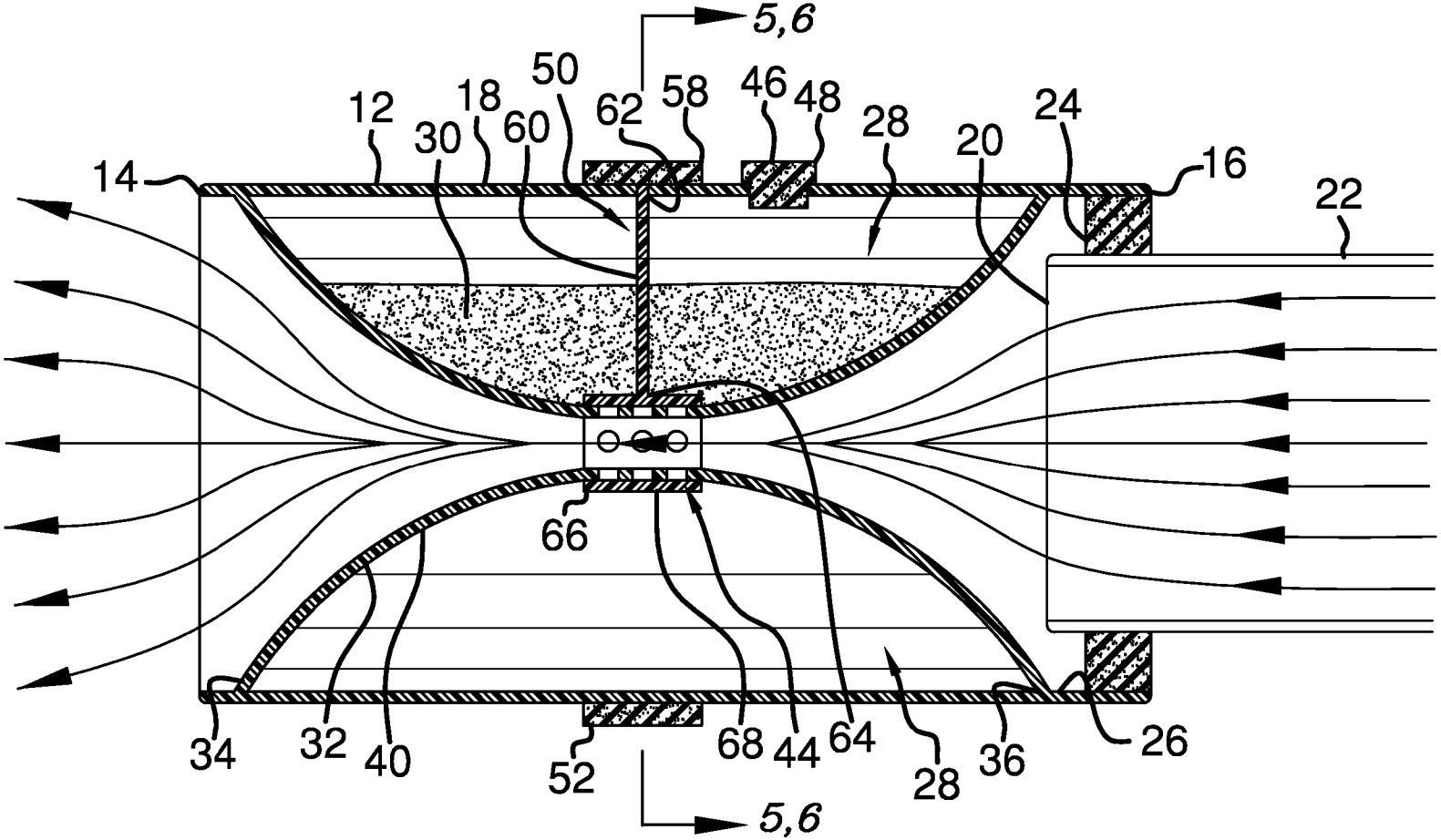
FIG. 4 is a cross sectional view taken along line 4-4 of FIG. 1 of an embodiment of the disclosure.
Figure 6:
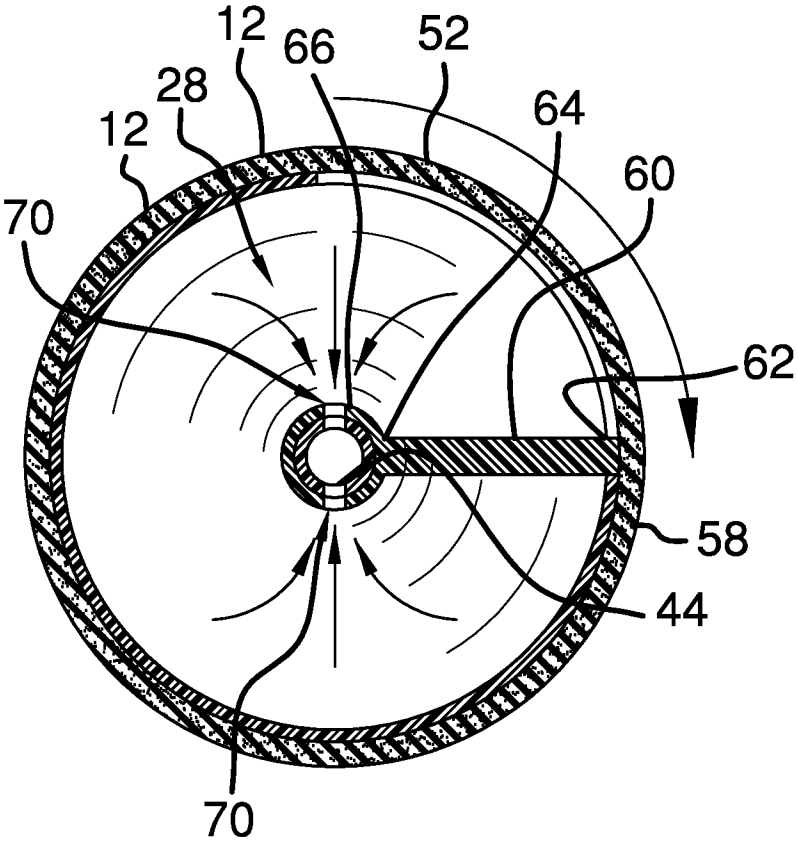
FIG. 6 is a cross sectional view taken along line 6-6 of FIG. 4 of an embodiment of the disclosure.
Figure 5:
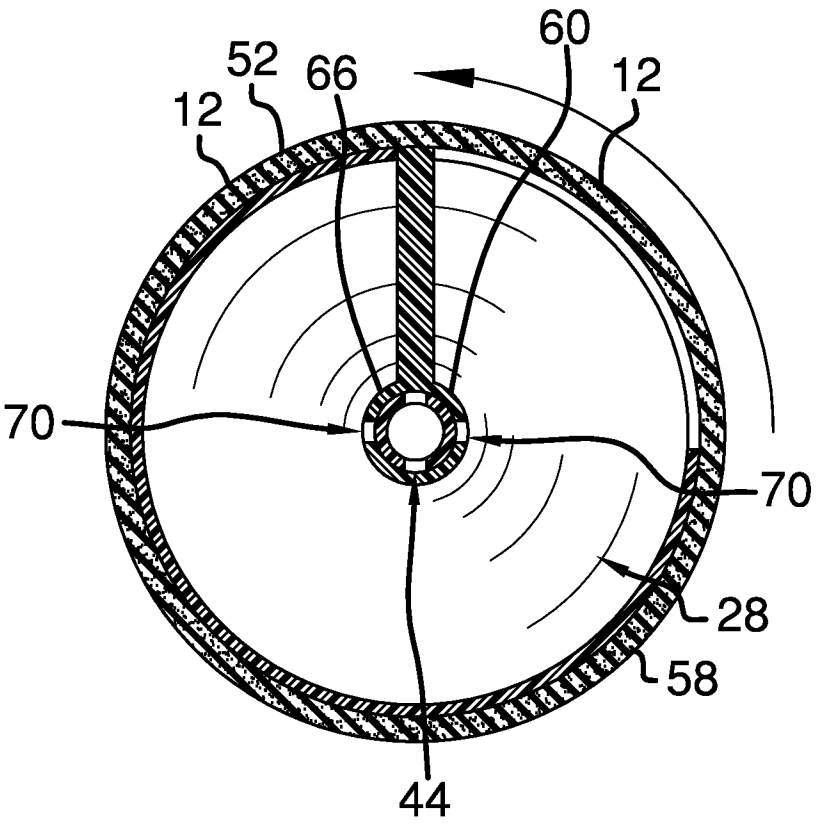
FIG. 5 is a cross sectional view taken along line 5-5 of FIG. 4 of an embodiment of the disclosure.
Figure 7:
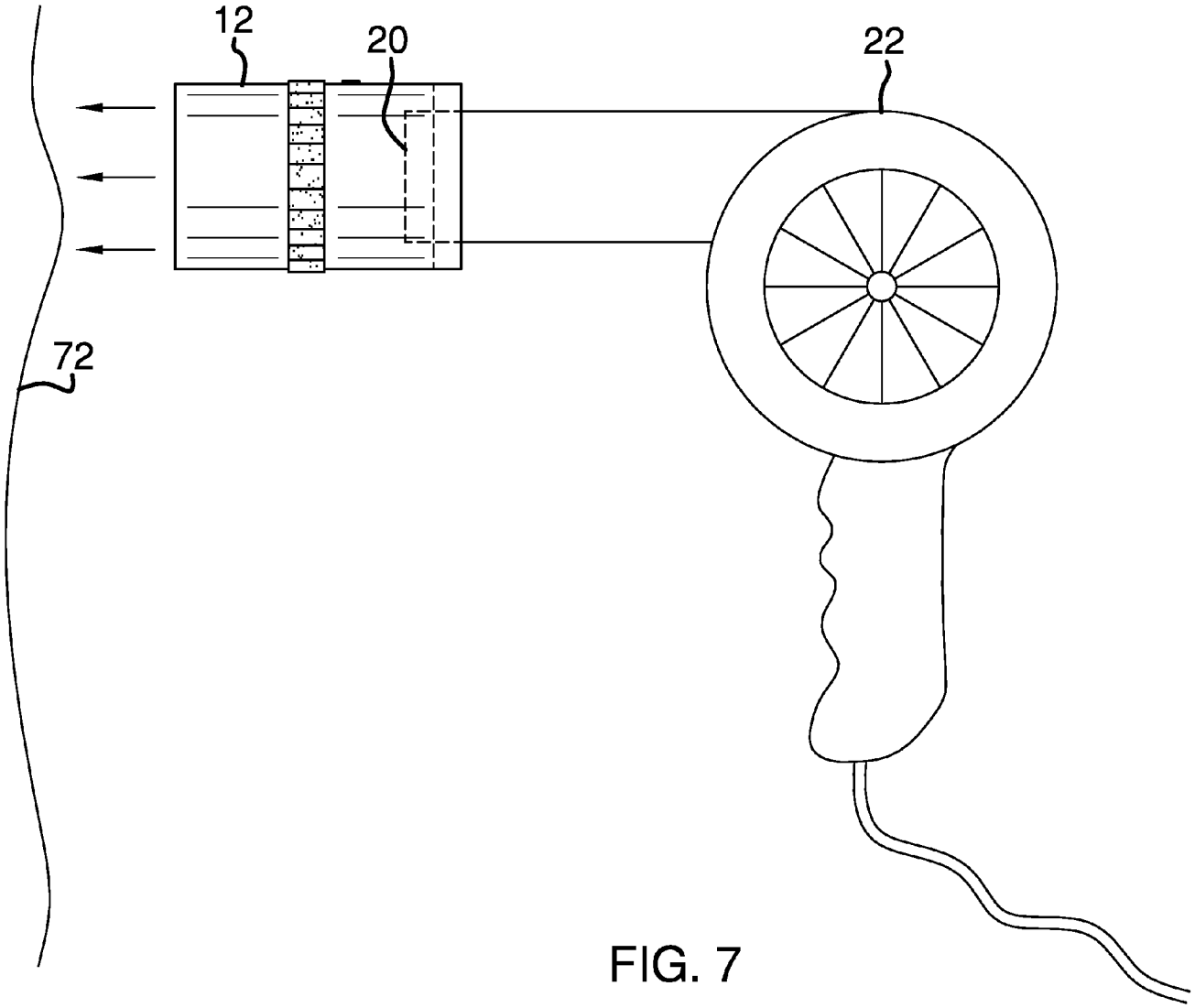
FIG. 7 is an in-use view of an embodiment of the disclosure.

With reference now to the drawings, and in particular to FIGS. 1 through 7 thereof, a new humidification device embodying the principles and concepts of an embodiment of the disclosure and generally designated by the reference numeral 10 will be described.

As best illustrated in FIGS. 1 through 7, the humidification assembly 10 generally comprises a housing 12 that has a first end 14, a second end 16 and a peripheral wall 18 extending therebetween. The first end 14 and the second end 16 are open. The housing 12 is substantially hollow. The peripheral wall 18 is curvilinear, giving the housing 12 a cylindrical shape. The first end 14 may insertably receive an air outlet 20 of a hair dryer 22. The hair dryer 22 may be a portable, electric hair dryer of any conventional design.

A gasket 24 is coupled to an inside surface 26 of the peripheral wall 18. The gasket 24 is coextensive with the first end 14. The gasket 24 may frictionally engage the hair dryer 22 air outlet 20 to retain the housing 12 on the hair dryer 22. The gasket 24 may be comprised of a resiliently compressible material.

A reservoir 28 is provided. The reservoir 28 may contain a fluid 30. The fluid 30 may be water. The reservoir 28 comprises a venturi 32 that has a front end 34, a rear end 36 and an outer wall 40 extending therebetween. The front end 34 and the rear end 36 are open. The venturi 32 is substantially hollow. The outer wall 40 flares outwardly at each of the front end 34 and the rear end 36 such that the venturi 32 has an hourglass shape.

The front end 34 and the rear end 36 are each coupled to the inner surface 26 of the peripheral wall 18 to define the reservoir 28 between the housing 12 and the venturi 32. The front end 34 and the rear end 36 are positioned proximate a respective one of the first end 14 and the second end 16. The venturi 32 may have air from the hair dryer 22 urged therethrough. The venturi 32 has a central section 42. The central section 42 has a plurality of first openings 44 extending into the reservoir 28.

The peripheral wall 18 has a fill aperture 46 extending into the reservoir 28. The fill aperture 46 may direct the fluid 30 into the reservoir 28. A closure 48 removably closes the fill aperture 46.

A valve 50 is provided. The valve 50 is movably coupled between the housing 12 and the venturi 32. The valve 50 may selectively release the fluid 30 into the venturi 32 to humidify the air urged by the hair dryer 22. The valve 50 comprises an actuator 52 rotatably coupled to and extending around an outer surface 54 of the peripheral wall 18. The actuator 52 is centrally positioned between the first end 14 and the second end 16.

The actuator 52 includes a ring 58 extending around an entire circumference of the housing 12. The actuator 52 may alternatively comprise an electrically actuated solenoid or the like. Additionally, the actuator 52 may comprise a mechanical fluid valve or the like.

The actuator 52 further includes an arm 60. The arm 60 has a top end 62 and a bottom end 64. The top end 62 is coupled to the actuator 52 such that the arm 60 extends into the reservoir 28. A sleeve 66 is provided. The sleeve 66 has a perimeter wall 68. The perimeter wall 68 is coupled to the bottom end 64. The sleeve 66 surrounds the central section 42 of the venturi 32.

The perimeter wall 68 has a plurality of second openings 70 extending therethrough. The second openings 70 are aligned with the first openings 44 when the actuator 52 is rotated into a releasing position. Thus, the sleeve 66 may release the fluid 30 into the venturi 32. The second openings 70 are moved away from the first openings 44 when the actuator 52 is rotated into a restricting position. Consequently, the sleeve 66 may prevent the fluid 30 from entering the venturi 32.

In use, the fluid 30 is poured into the reservoir 28 through the fill aperture 46. The housing 12 is coupled to the hair dryer 22. The actuator 52 is positioned in the releasing position to humidify the air urged by the hair dryer 22. The humidified air is directed onto a fabric 72 to eliminate wrinkles in the fabric 72. The fabric 72 may be a textile of any conventional design.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A humidification assembly configured to be coupled to a hair dryer, said assembly comprising:

a housing having a first end, a second end and a peripheral wall extending therebetween, said first end and said second end being open, said housing being substantially hollow, said peripheral wall being curvilinear such that said housing has a cylindrical shape, said first end being configured to insertably receive a hair dryer air outlet;

a gasket coupled to an inside surface of said peripheral wall, said gasket being coextensive with said first end, said gasket being configured to frictionally engage the hair dryer air outlet to retain said housing on the hair dryer;

a reservoir configured to contain a fluid, said reservoir comprising a venturi;

said peripheral wall having a fill aperture extending into said reservoir, said fill aperture being configured to direct the fluid into said reservoir;

a closure removably closing said fill aperture;

a valve movably coupled between said housing and said venturi, said valve being configured to selectively release the fluid into said venturi to humidify the air urged by the hair dryer, said valve comprising an actuator rotatably coupled to and extending around an outer surface of said peripheral wall, said actuator being centrally positioned between said first end and said second end; and an arm having a top end and a bottom end, said top end being coupled to said actuator such that said arm extends into said reservoir.

2. The assembly according to claim 1, further comprising said venturi having a front end, a rear end and an outer wall extending therebetween, said front end and said rear end being open, said venturi being substantially hollow, said outer wall flaring outwardly at each of said front end and said rear end such that said venturi has an hourglass shape.

3. The assembly according to claim 2, further comprising said front end and said rear end being coupled to an inner surface of said peripheral wall to define said reservoir between said housing and said venturi, said front end and said rear end being positioned proximate a respective one of said first end and said second end, said venturi being configured to have air from the hair dryer urged therethrough.

4. The assembly according to claim 3, wherein said venturi has a central section, said central section having a plurality of first openings extending into said reservoir.

5. The assembly according to claim 1, further comprising:

a venturi having a central section;

said central section having a plurality of first openings extending into said fluid reservoir; and a sleeve having a perimeter wall, said perimeter wall being coupled to said bottom end, said sleeve surrounding said central section of said venture.

6. The assembly according to claim 5, wherein said perimeter wall has a plurality of second openings extending therethrough, said second openings being aligned with said first openings when said actuator is rotated into a releasing position wherein said sleeve is configured to release the fluid into said venturi.

7. The assembly according to claim 6, further comprising said second openings being moved away from said first openings when said actuator is rotated into a restricting position wherein said sleeve is configured to prevent the fluid from entering said venturi.

8. A humidification assembly configured to be coupled to a hair dryer, said assembly comprising:

a housing having a first end, a second end and a peripheral wall extending therebetween, said first end and said second end being open, said housing being substantially hollow, said peripheral wall being curvilinear such that said housing has a cylindrical shape, said first end being configured to insertably receive a hair dryer air outlet;

a gasket coupled to an inside surface of said peripheral wall, said gasket being coextensive with said first end, said gasket being configured to frictionally engage the hair dryer air outlet to retain said housing on the hair dryer;

a reservoir configured to contain a fluid, said reservoir comprising:

a venturi having a front end, a rear end and an outer wall extending therebetween, said front end and said rear end being open, said venturi being substantially hollow, said outer wall flaring outwardly at each of said front end and said rear end such that said venturi has an hourglass shape, said front end and said rear end being coupled to an inner surface of said peripheral wall to define said reservoir between said housing and said venturi, said front end and said rear end being positioned proximate a respective one of said first end and said second end, said venturi being configured to have air from the hair dryer urged therethrough, said venturi having a central section, said central section having a plurality of first openings extending into said reservoir;

said peripheral wall having a fill aperture extending into said reservoir, said fill aperture being configured to direct the fluid into said reservoir;

a closure removably closing said fill aperture;

a valve movably coupled between said housing and said venturi, said valve being configured to selectively release the fluid into said venturi to humidify the air urged by the hair dryer, said valve comprising:

an actuator rotatably coupled to and extending around an outer surface of said peripheral wall, said actuator being centrally positioned between said first end and said second end;

an arm having a top end and a bottom end, said top end being coupled to said actuator such that said arm extends into said reservoir; and a sleeve having a perimeter wall, said perimeter wall being coupled to said bottom end, said sleeve surrounding said central section of said venturi, said perimeter wall having a plurality of second openings extending therethrough, said second openings being aligned with said first openings when said actuator is rotated into a releasing position wherein said sleeve is configured to release the fluid into said venturi, said second openings being moved away from said first openings when said actuator is rotated into a restricting position wherein said sleeve is configured to prevent the fluid from entering said venturi.

* * * * *